US005664347A

United States Patent [19]

Chapman, Sr. et al.

[11] Patent Number: 5,664,347

[45] Date of Patent: Sep. 9, 1997

[54] POWERTRAIN FOR TRENCHING MACHINE

[75] Inventors: Harold L. Chapman, Sr., Leander; Harold L. Chapman, Jr., Florence; Darvin L. Willhoite, Leander, all of Tex.

[73] Assignee: Austin Trencher Incorporated, Leander, Tex.

[21] Appl. No.: 523,722

[22] Filed: Sep. 5, 1995

[51] Int. Cl.[6] ..... E02F 3/65

[52] U.S. Cl. ..... 37/362; 37/360; 180/14.4; 474/146

[58] Field of Search ..... 37/355, 352, 353, 37/360, 361, 362, 97, 184, 190; 74/665 E; 474/144, 146; 180/14.7

[56] References Cited

U.S. PATENT DOCUMENTS

| | | | |
|---|---|---|---|
| 940,752 | 11/1909 | Toupin . | |
| 1,027,605 | 5/1912 | Hoffman et al. | 474/146 X |
| 1,074,947 | 10/1913 | Heath | 474/146 X |
| 1,199,844 | 10/1916 | Watts . | |
| 1,306,350 | 6/1919 | McIntire | 37/362 X |
| 1,762,568 | 6/1930 | Barber | 37/360 |
| 1,804,587 | 5/1931 | Bowman et al. | 37/360 X |
| 1,806,511 | 5/1931 | Vaughn . | |
| 2,311,834 | 2/1943 | Hollmann et al. | 37/360 |
| 2,328,804 | 9/1943 | Hollmann et al. | 37/362 X |
| 2,550,071 | 4/1951 | Larkin | 37/90 |
| 2,584,287 | 2/1952 | Przybylski | 37/90 |
| 2,599,778 | 6/1952 | Przybylski | 37/90 |
| 2,710,466 | 6/1955 | Chartier | 37/360 X |
| 2,747,307 | 5/1956 | Griffin | 37/360 |
| 2,762,137 | 9/1956 | Wells | 37/410 X |
| 2,783,654 | 3/1957 | Carnell | 474/146 X |
| 3,018,572 | 1/1962 | Zimmerman, Jr. | 37/361 |
| 3,059,714 | 10/1962 | Johnson | 180/14.4 |
| 3,141,341 | 7/1964 | Hutchinson | 474/146 X |
| 3,206,877 | 9/1965 | Metailler | 37/362 |
| 4,139,073 | 2/1979 | Curtis et al. | 180/14.4 X |
| 4,171,582 | 10/1979 | Morooka | 37/90 |
| 4,884,949 | 12/1989 | Eakin | 474/146 X |
| 5,203,100 | 4/1993 | Snyder et al. | 37/362 X |
| 5,245,769 | 9/1993 | Wammock | 37/362 X |

*Primary Examiner*—Randolph A. Reese
*Assistant Examiner*—Thomas A. Beach
*Attorney, Agent, or Firm*—Sidley & Austin

[57] ABSTRACT

A trenching machine includes a vehicle, an engine transmission assembly, a transfer box assembly, an elevated differential gearbox, a trenching chain drive shaft, a pair of roller chains engaging the trenching chain drive shaft and the output shaft of the differential gearbox, a trenching chain assembly mounted on and driven by the trenching chain drive shaft; and a discharge conveyor positioned below the differential gearbox and the pair of roller chains. The transfer box assembly, which transfers power from the engine transmission assembly vertically to the elevated differential gearbox, includes a sealed but accessible housing, a lower shaft, an upper shaft positioned parallel to and vertically above the lower shaft, and a roller chain running on sprockets on the upper and lower shafts. The lower shaft is connected to the engine transmission output shaft by a first universal joint, while the upper shaft is connected to the input of the differential gearbox by a second universal joint. Each of the upper and lower shafts is supported by a pair of roller bearings mounted in bearing housings, with one set of bearing housings having offset bores in which the roller bearings are mounted so that the distance between the shafts can be varied by rotating that set of bearing housings.

8 Claims, 3 Drawing Sheets

POWERTRAIN FOR TRENCHING MACHINE

TECHNICAL FIELD OF THE INVENTION

The invention relates to a powertrain for a trenching machine which effectively transfers power from an engine to a trenching chain assembly. In one aspect, the invention relates to a powertrain having a transfer box to raise the position of a differential gearbox so as to more readily accommodate a spoil discharge conveyor that removes dirt and rocks from the trenching machine. In another aspect, the invention relates to a trenching machine having an improved powertrain requiring fewer drive chains.

BACKGROUND OF THE INVENTION

In order to excavate dirt and rocks to create a trench, large trenching machines typically use a large trenching chain assembly comprising a pair of endless chains mounted in parallel with each other between a pair of sprockets on a drive shaft and a pair of sprockets on a distal shaft, with a plurality of digging buckets or a plurality of heavy toothed plates having their lateral ends positioned on and mounted to the two endless chains. Such trenching requires heavy duty machinery as well as the ability to withstand the tremendous torque changes which occur when the buckets or toothed plates on the trenching chains encounter large rocks or other hard materials during the trenching operation. The powertrain for such a trenching machine must be able to effectively transfer power from an engine to the drive shaft of the trenching chain assembly. At the same time, the design of the typical trenching machine is such that the spoil discharge conveyor, which receives debris from the buckets or toothed plates and conveys such debris away from the trenching machine, must be accommodated underneath the powertrain.

Existing trenching machines typically have complicated powertrains using multiple bearings, chains and shafts to transfer power from the engine to the trenching chain assembly while at the same time creating space for the spoil discharge conveyor underneath the powertrain. One such conventional powertrain comprises an engine, a transmission, a differential gearbox connected directly to the transmission output, two parallel roller chains connecting sprockets on the two ends of the output shaft of the differential gearbox to two sprockets on the two ends of an intermediate shaft, a trenching chain drive shaft, and two parallel roller chains connecting two other sprockets on the intermediate shaft to two sprockets on the two ends of the trenching chain drive shaft. The intermediate shaft is positioned rearwardly of the differential gearbox at a higher elevation than the differential gearbox, while the trenching chain drive shaft is positioned rearwardly of the intermediate shaft. The use of such a large number of powertrain components adds to the unreliability of the powertrain and results in the trenching machine having an undesirably long overall length. Moreover, many conventional trenching machines do not always provide adequate clearance under the powertrain for large rocks or other debris on the spoil discharge conveyor.

A need exists for a simplified powertrain for use in a trenching machine which increases the reliability of the powertrain, shortens the overall lengths of the powertrain and the trenching machine, and readily accommodates adequate clearance for the spoil discharge conveyor so that large rocks and other debris can be conveyed underneath the powertrain and away from the trenching machine without damage to the trenching machine.

SUMMARY OF THE INVENTION

In accordance with one aspect of the present invention, a transfer box assembly, suitable for use in a powertrain for a trenching machine, comprises a transfer box housing; a lower shaft rotatably mounted in the transfer box housing, an input end of the lower shaft being adapted to be coupled to a drive shaft; a lower sprocket mounted on the lower shaft; an upper shaft rotatably mounted in the transfer box housing above the lower shaft, the upper shaft having an output end; an upper sprocket mounted on the upper shaft and located generally vertically above the lower sprocket; and a transfer roller chain engaged around the lower sprocket and the upper sprocket such that rotation of the lower shaft causes the upper shaft to rotate. The lower shaft and the upper shaft are preferably mounted in the transfer box housing so as to be parallel to each other. The transfer box housing can comprise a box body and a top lid, with the top lid being removably attached to the top of the box body so as to allow access to components within the transfer box housing, and so as to seal the transfer box housing to allow containment of lubricating oil for the transfer roller chain.

In a presently preferred embodiment of the transfer box assembly, a first upper bearing housing and a second upper bearing housing are oppositely mounted in the transfer box housing, each mounting a roller bearing which in turn rotatably supports the upper shaft, and a first lower bearing housing and a second lower bearing housing are oppositely mounted in the transfer box housing, each mounting a roller bearing which in turn rotatably supports the lower shaft. At least one of the upper set of bearing housings and the lower set of bearing housings has off center bores within which the associated roller bearings are mounted, such that when the bearing housings having the offset bores are rotated, a distance between a center line of the upper shaft and a center line of the lower shaft changes.

In accordance with another aspect of the invention, the transfer box assembly is incorporated into a powertrain, comprising an engine transmission assembly having a rotatably driven transmission output drive shaft, the lower shaft of the transfer box assembly being connected to the transmission output drive shaft; and a differential gearbox having an input shaft and a transverse output shaft, the input shaft being generally axially aligned with and coupled to the output end of the upper shaft, with the transverse output shaft having an axis of rotation which is generally perpendicular to an axis of rotation of the input shaft.

In a presently preferred embodiment, the powertrain also includes a first universal joint connected between the transmission output shaft and the lower shaft, and a second universal joint connected between the upper shaft and the input shaft of the differential gearbox.

In accordance with another aspect of the invention, the powertrain is incorporated into a trenching machine comprising a vehicle on which the powertrain is mounted, a trenching chain drive shaft mounted on the vehicle; a pair of roller chains engaging the trenching chain drive shaft and the transverse output shaft for rotating the trenching chain drive shaft; a trenching chain assembly mounted on and driven by the trenching chain drive shaft; and a discharge conveyor positioned on the vehicle below the differential gearbox and the pair of roller chains, for receiving debris from the trenching chain assembly and for conveying the thus received debris away from the trenching machine.

The present invention provides for the efficient transfer of power from the engine transmission assembly vertically upwardly to the differential gearbox thereby allowing sufficient room for a spoil discharge conveyor to pass debris underneath the differential gearbox. Another advantage of the present invention is to shorten the overall length of the powertrain and to increase the reliability of the powertrain by eliminating additional components typically needed to transfer power from the engine transmission assembly to the trenching chain drive shaft.

BRIEF DESCRIPTION OF THE DRAWINGS

The present invention will be better understood upon reading the detailed description of a presently preferred embodiment of the invention, set forth below in connection with the following drawings, wherein like reference numerals designate like or corresponding parts throughout the several views.

DETAILED DESCRIPTION

Figure 1:
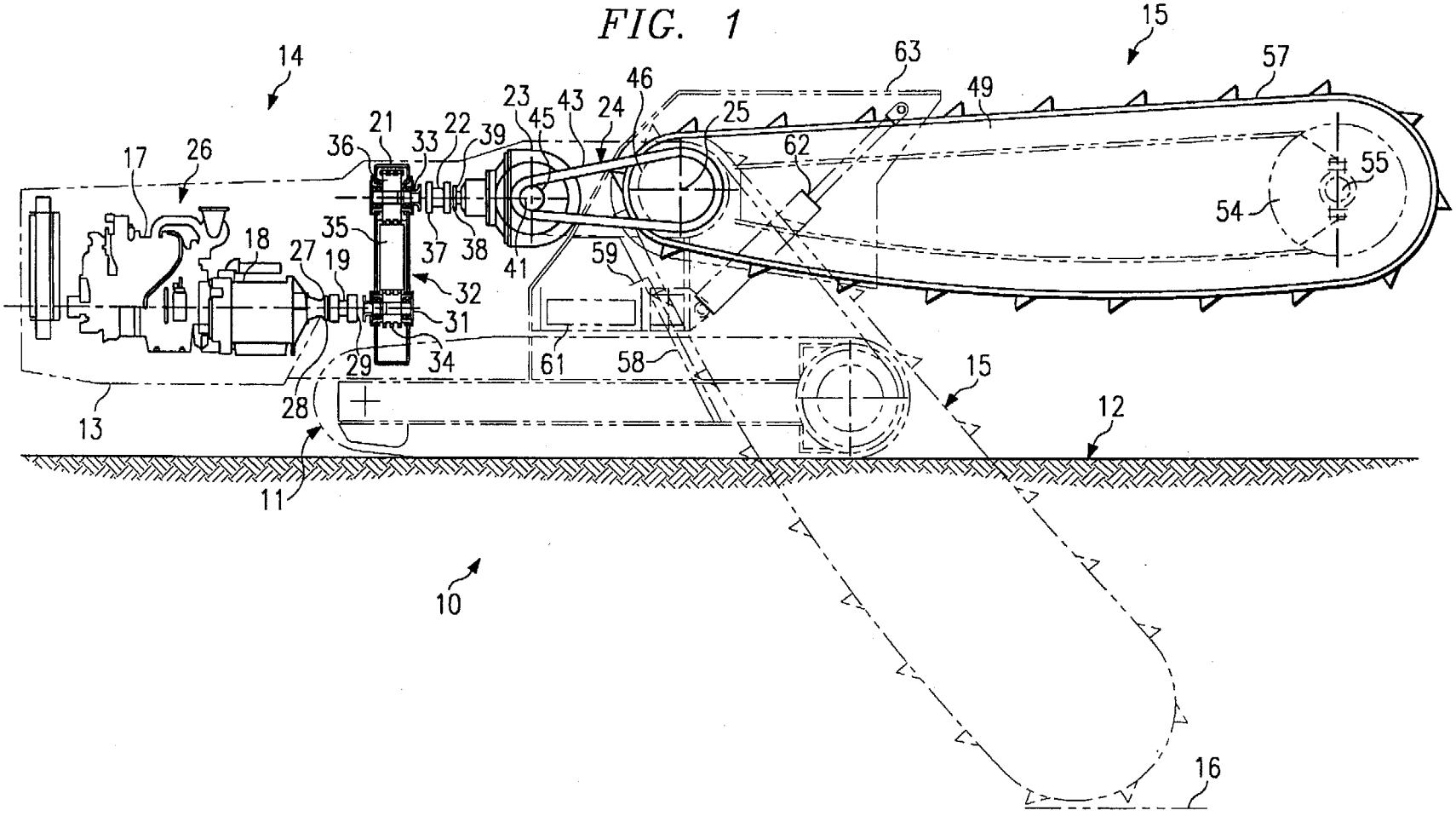
FIG. 1 is a side view of a trenching machine incorporating a presently preferred embodiment of the powertrain of the present invention.
Figure 2:
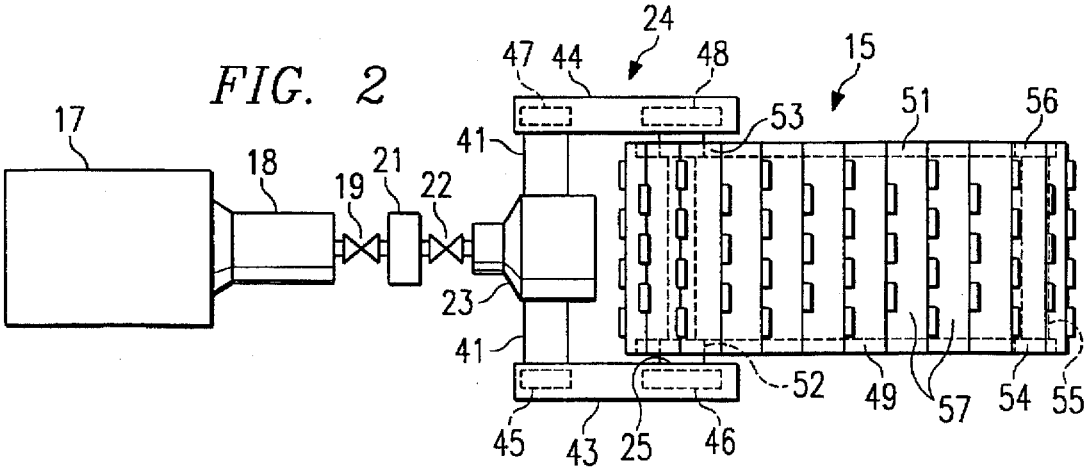
FIG. 2 is a plan view of the powertrain and trenching chain assembly of the trenching machine of FIG. 1.

Referring to FIGS. 1 and 2, the trenching machine 10 comprises a crawler vehicle 11 which travels on the surface 12 of the earth, a frame 13 which is mounted on the vehicle 11, a powertrain 14 which is mounted on the frame 13, and a trenching chain assembly 15 which is driven by the powertrain 14 to excavate a trench 16 in the earth.

The powertrain 14 comprises an engine 17, a transmission 18, a first universal joint 19, a transfer box assembly 21, a second universal joint 22, a power equalizing differential gearbox 23, a roller chain assembly 24, and a trenching chain drive shaft 25, with each of the engine 17, the transmission 18, the transfer box assembly 21, the differential gearbox 23, and the trenching chain drive shaft 25 being suitably mounted on the frame 13.

The engine 17 can be any suitable type of engine, for example a high horsepower diesel engine. The output of the engine 17 is coupled to the input of the transmission 18, which is preferably a multiple speed, power shift type transmission with an integral torque converter. Preferably, the torque converter of the transmission 18 is a three element type torque converter that multiplies the output torque of the transmission 18 as the load on the trenching machine 10 increases and also absorbs some of the shocks generated when rocky conditions are encountered in a trenching operation. The engine 17 and the transmission 18 make up an engine transmission assembly 26 that includes a transmission output shaft 27 which is rotatably driven by the output of the engine 17 via the transmission 18. The engine transmission assembly 26 is preferably positioned so that the transmission output shaft 27 extends at least generally parallel to the longitudinal axis of the frame 13. In a presently preferred embodiment, a Caterpillar 3408 diesel engine is used as the engine 17 and an Allison CLBT 6061 transmission is used as the transmission 18.

The first universal joint 19 has an input end 28 and an output end 29. The transmission output shaft 27 is coupled directly to the input end 28 of the first universal joint 19, while the output end 29 of the first universal joint 19 is coupled directly to the lower shaft 31 of the transfer box assembly 21. The lower shaft 31 is preferably positioned so as to be at least substantially coaxial with the transmission output shaft 27. However, the first universal joint 19 is included in the powertrain 14 to allow for slight misalignments between the transmission output shaft 27 and the lower shaft 31, due to either manufacturing tolerances or frame distortions during a trenching operation. The first universal joint 19 also facilitates the installation of the transfer box assembly 21 in the powertrain 14, as well as the removal of the transfer box assembly 21 from the powertrain 14. In the preferred embodiment, a Twin Disc J800 is used as first universal joint 19.

The transfer box assembly 21 comprises a transfer box housing 32, in which the lower shaft 31 and an upper shaft 33 are rotatably mounted parallel to each other, with the longitudinal axis of each of the shafts 31 and 33 being generally horizontal and also generally parallel to the longitudinal axis of the frame 13. A lower sprocket 34, which is mounted concentrically on the lower shaft 31, drives an endless transfer roller chain 35, which is inside the transfer box housing 32. The transfer roller chain 35 engages and rotatably drives an upper sprocket 36 which is mounted concentrically on the upper shaft 33. Any suitable roller chain can be employed as the transfer roller chain 35, for example, a triple strand, size 200, roller chain. However, in the preferred embodiment, a four strand, size 160 roller chain is used as the transfer roller chain 35.

The output end of the upper shaft 33 extends outwardly from the top portion of the transfer box housing 32 and is directly coupled to the input end 37 of the second universal joint 22. The output end 38 of the second universal joint 22 is directly coupled to the input shaft 39 of the differential gearbox 23. The upper shaft 31 is preferably positioned so as to be at least substantially coaxial with the input shaft 39. However, the presence of the second universal joint 22 in the powertrain 14 allows for slight misalignment of the upper shaft 33 and the input shaft 39 of the differential gearbox 23, due to either manufacturing tolerances or frame distortions during a trenching operation. Additionally, the second universal joint 22 facilitates the installation of the transfer box assembly 21 in the powertrain 14, as well as the removal of the transfer box assembly 21 from the powertrain 14. In the preferred embodiment, a Twin Disc J800 is used as the second universal joint 22.

The differential gearbox 23 has an output shaft 41, which extends transversely outwardly from each side of the differential gearbox 23. The longitudinal axis of the output shaft 41 is generally horizontal and also generally perpendicular to the longitudinal axis of the frame 13. In the preferred embodiment, a Caterpillar 992 differential gearbox is used as the differential gearbox 23. The output shaft 41 and the trenching chain drive shaft 25 are mounted with their longitudinal axes being parallel to each other. A roller chain assembly 24 comprises a pair of endless roller chains 43 and 44 mounted parallel to each other, with a first one 43 of the pair of roller chains engaging a sprocket 45 on the left end of output shaft 41 and a sprocket 46 on the left end of the trenching chain drive shaft 25, and with the second one 44 of the pair of roller chains engaging a sprocket 47 on the right end of output shaft 41 and a sprocket 48 on the right end of the trenching chain drive shaft 25. Thus, the differential gearbox output shaft 41 simultaneously drives both ends of the trenching chain drive shaft 25.

The trenching chain drive assembly 15 comprises a pair of endless chains 49 and 51 mounted in parallel with each other between a pair of sprockets 52 and 53 on the trenching chain drive shaft 25 and a pair of sprockets 54 and 56 on the distal shaft 55, with a plurality of heavy toothed plates 57 having their lateral ends positioned on and mounted to the two endless chains 49 and 51. Thus, the rotation of the trenching chain drive shaft 25 drives the trenching chain assembly 15 so that the chains 49 and 51 and the plates 57 travel around the distal shaft 55 such that the plates 57 can consecutively make contact with earth being excavated. The plates 57 can be formed of high strength steel with the teeth being carbide tipped.

When the trenching chain assembly 15 is in a trenching position, soil excavated from the trench 16 is carried by the plates 57, mounted on the lower flight of the chains 49 and 51, upwardly toward the trenching chain drive shaft 25 until the excavated soil passes over a plate 58 and spills over the lip 59 at the top edge of plate 58 and downwardly onto the spoil discharge conveyor 61. The spoil discharge conveyor 61 conveys the soil excavated from trench 16 away from the trenching operation in a direction generally perpendicular to the longitudinal axis of the vehicle 11 and thus also generally perpendicular to the direction of travel of the vehicle 11. The trenching chain assembly 15 can be raised to and from the trenching position by the hydraulic actuator 62. A housing shield 63 can be disposed around the upper end of the trenching chain assembly 15 and the trenching chain drive shaft 25.

The use of the transfer box assembly 21 raises the vertical position of the differential gearbox 23 and allows more vertical room for the soil on the spoil discharge conveyor 61. Furthermore, the feature of the transfer box assembly 21 having a vertical orientation permits the overall length of the powertrain 14 to be shorter than that of a conventional powertrain wherein the output shaft of the differential gearbox is connected by two parallel roller chains to an intermediate shaft, positioned rearwardly of the differential gearbox, which in turn is connected by two parallel roller chains to the trenching chain drive shaft, even though the differential gearbox is connected directly to the transmission. The powertrain 14 has only two pairs of drive chains 43, 44 and 49, 51 and the transfer roller chain 35, in contrast to three pairs of drive chains in that conventional powertrain. Similarly, the powertrain 14 has only eight sprockets in contrast to the twelve sprockets in that conventional powertrain. Thus, the powertrain requires fewer components, reducing the initial cost as well as reducing the potential for mechanical breakdowns.

Figure 3:
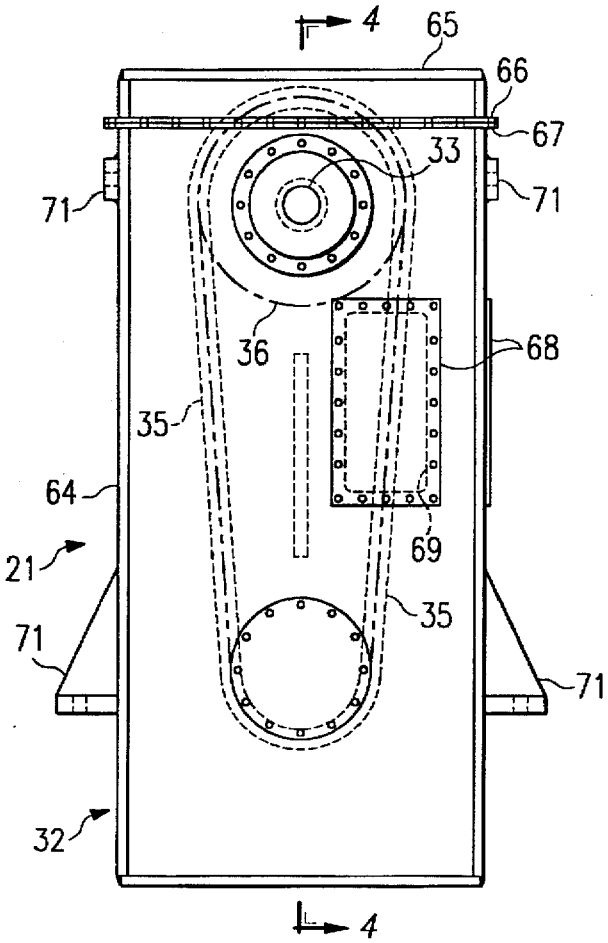
FIG. 3 is a side view of the transfer box of the powertrain of FIG. 1.
Figure 4:
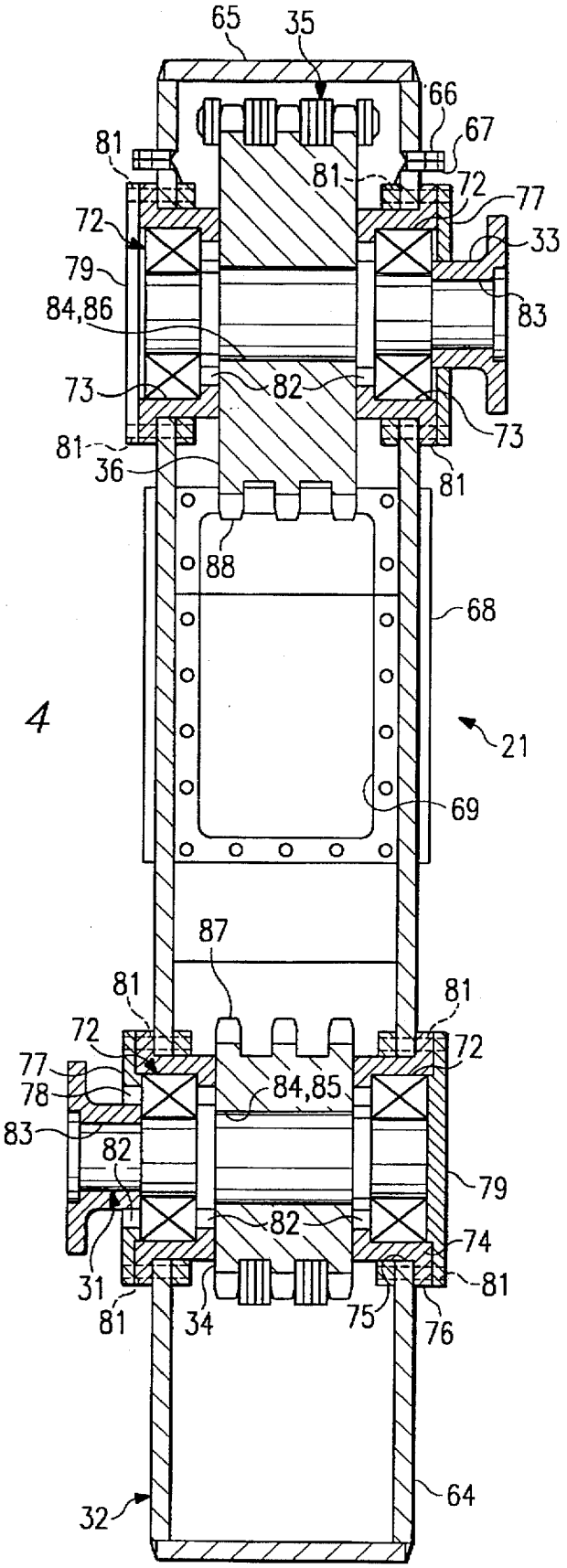
FIG. 4 is a cross-section view, taken along line 4—4 in FIG. 3.

With reference to FIGS. 3 and 4, the transfer box assembly 21 of the present invention will be described in further detail. The transfer box housing 32, which can be made of plate metal, comprises a box body 64, having generally rectangular side walls, and a generally rectangular top lid 65. The top lid 65 is provided with a lid flange 66 which can be bolted to a box flange 67 on the box body 64. The top lid 65 allows for ease of access to the roller chain assembly 35 which is within transfer box housing 32. The transfer box housing 32 also includes access panels 68 which cover access openings 69 in the vertical walls of the box body 64, to allow servicing of the roller chain assembly 35. The transfer box housing 32 is sealed to allow containment of lubricating oil for the endless transfer chain 35. The lubricating oil level in the transfer box housing 32 will generally be near the centerline of the lower shaft 31, so that the endless transfer chain 35 is totally submerged in the lubricating oil as the endless transfer chain 35 passes around the sprocket 34 on the lower shaft 31. The transfer box housing 32 has various mounting lugs 71 so that the transfer box housing 32 can be rigidly mounted to the frame 13 and allow an efficient transfer of power from the lower shaft 31 to the upper shaft 33. The transfer box housing 32 can be readily installed during initial assembly and also easily removed for repair, involving the connection/disconnection of the two universal joints and the installation/removal of the bolts securing the mounting lugs to the frame 13.

The lower shaft 31 and the upper shaft 33 are preferably identical in size and configuration so that each of these shafts can be mounted in the transfer box housing 32 with a commonality of components. Thus, each of the lower shaft 31 and the upper shaft 33 is positioned in the transfer box housing 32 by being trunnion mounted in a respective pair of large spherical roller type bearings 72, with each roller bearing 72 being mounted in a corresponding bore 73 in the respective bearing housing 74. Each of the bearing housings 74 is located in a respective circular bearing opening 75 in the transfer box housing 32. At least one of the pairs of bearing housings 74, preferably the upper bearing housings, has its bores 73 bored off center so that when the bearing housings 74 are rotated in their respective bearing openings 75, the distance between the rotational axis of the upper shaft 33 and the rotational axis of the lower shaft 31 changes, thereby allowing adjustment to the slack in the roller chain 35.

Each bearing housing 74 has a bearing housing flange 76 for engaging the box body 64. Where each of the shafts 31 and 33 extends out of the transfer box housing 32, an annular cover plate 77, provided with a shaft opening 78, covers the adjacent roller bearing 72. A pair of closed cover plates 79 is used to cover the opposite end of each of the shafts 31 and 33, which are disposed within the transfer box housing 32. The bolts 81 are mounted through the respective one of the cover plates 77 and 79, through the respective bearing housing flange 76, and into the box body 64. The roller bearings 72 are lubricated with grease, and annular bearing seals 82 are disposed about each of the shafts 31 and 33 on each side of the respective roller bearings 72 to prevent ingress of contaminates. The use of identical shafts 31 and 33 permits all of the roller bearings 72 to be identical to each other and all of the seals 82 to be identical to each other.

Each of the shafts 31 and 33 can have end splines 83 which serve to mate with an oppositely splined shaft of the adjacent universal joint 19 or 22. Thus, the output end 29 of the first universal joint 19 can be splined to be received within end splines 83 of the lower shaft 31. Similarly, the input end 37 of the second universal joint 22 can be splined to be received within the end splines 83 of the upper shaft 33. Each of the shafts 31 and 33 can also have center splines 84, which serve to engage the splines 85 or 86 of the associated one of the sprockets 34 and 36. Thus, the lower shaft 31 has center splines 84 which engage the splines 85 on the lower sprocket 34, while the upper shaft 33 has center splines 84 which engage the splines 86 on the upper sprocket 36. The utilization of splines for connecting the shafts allows easy assembly and good torque transmission capability. The lower sprocket 34 has teeth 87 which engage the roller chain assembly 35, which in turn engages the teeth 88 of the upper sprocket 36. The arrangement of the lower sprocket 34, the upper sprocket 36, and the endless transfer roller chain 35 provides a reduction ratio to reduce the rotation speed and to increase the torque. Similarly, the arrangement of the drive sprockets 45 and 47, the driven sprockets 46 and 48, and the pair of endless chains 43 and 44 also provides a reduction ratio to further reduce the rotation speed and to increase the torque transmitted to the trenching chain assembly 15.

The operation of the transfer box assembly 21 is straightforward. The output shaft 29 of the first universal joint 19 rotates the lower shaft 31 via a spline coupling.

The lower shaft 31 in turn rotates the lower sprocket 34 via a spline connection. The sprocket teeth 87 on the lower sprocket 34 engage and rotate the roller chain assembly 35, which in turn engages the teeth on the upper sprocket 36 and thereby rotates the upper sprocket 36. The upper sprocket 36 in turn rotates the upper shaft 33 through a spline connection. The upper shaft 33 rotates the input shaft 37 of the second universal joint 22, also through a spline connection. As can be seen, power is transferred vertically upwardly from the engine transmission assembly 26 to the input of the differential gearbox 23, so that even though the differential gearbox 23 and the roller chain assembly 24 extend rearwardly over the conveyor 61, the differential gear box 23 and the roller chain assembly 24 are sufficiently elevated to provide for adequate clearance for large rocks on the spoil discharge conveyor 61.

While the preferred embodiment of the present invention has been illustrated in the accompanying drawings, and described in the foregoing detailed description, it will be understood that the invention is not limited to the preferred embodiment disclosed, but is capable of numerous rearrangements, modifications and substitutions of parts and elements without departing from the spirit of the invention as defined by the following claims.

We claim:

1. A trenching machine comprising:

a vehicle having a longitudinal axis;

an engine transmission assembly mounted on said vehicle and having a rotatably driven transmission output shaft which extends generally horizontally and generally parallel to said longitudinal axis;

a transfer box assembly mounted on said vehicle, said transfer box assembly comprising:

a transfer box housing;

a lower shaft rotatably mounted in said transfer box housing and generally axially aligned with said transmission output shaft, with an input end of said lower shaft being coupled to said transmission output shaft;

a lower sprocket mounted on said lower shaft;

an upper shaft rotatably mounted in said transfer box housing above said lower shaft, said upper shaft having an output end, said upper shaft being positioned vertically above said lower shaft, each of said lower shaft and said upper shaft being positioned generally horizontally and generally parallel to each other and to said longitudinal axis;

an upper sprocket mounted on said upper shaft and located generally vertically above said lower sprocket; and a transfer roller chain engaged around said lower sprocket and said upper sprocket such that rotation of said lower shaft causes said upper shaft to rotate;

a differential gearbox mounted on said vehicle and having an input shaft and a transverse output shaft, said input shaft being generally axially aligned with and coupled to said output end of said upper shaft, said transverse output shaft extending generally horizontally and having an axis of rotation which is generally perpendicular to an axis of rotation of said input shaft;

a trenching chain drive shaft mounted on said vehicle;

a pair of roller chains engaging said trenching chain drive shaft and said transverse output shaft for rotating said trenching chain drive shaft;

a trenching chain assembly mounted on and driven by said trenching chain drive shaft; and a discharge conveyor positioned on said vehicle directly below each of said differential gearbox and said pair of roller chains, for receiving debris from said trenching chain assembly and for conveying the thus received debris away from the trenching machine;

wherein a vertical spacing of said upper shaft with respect to said lower shaft provides a vertical position of each of said differential gearbox and said pair of roller chains directly above said discharge conveyor which is sufficient to provide adequate clearance for large rocks discharged onto said discharge conveyor by said trenching chain assembly; and wherein the positioning of said upper shaft vertically above said lower shaft reduces a required length parallel to said longitudinal axis between said transmission output shaft and said trenching chain drive shaft.

2. A trenching machine in accordance with claim 1, further comprising a first universal joint having an input end and an output end, and a second universal joint having an input end and an output end, wherein said input end of said first universal joint is coupled to said transmission output shaft, wherein said input end of said lower shaft is coupled to said output end of said first universal joint, wherein said input end of said second universal joint is coupled to said output end of said upper shaft, and wherein said output end of said second universal joint is coupled to said input shaft of said differential gearbox.

3. A trenching machine in accordance with claim 1, wherein said transfer box housing comprises a box body and a top lid, said top lid being removably attached to the top of said box body so as to allow access to components within said transfer box housing.

4. A trenching machine in accordance with claim 1, wherein said transfer box housing is sealed so as to allow containment of lubricating oil for said transfer roller chain.

5. A trenching machine in accordance with claim 1, wherein said transfer box assembly further comprises a first upper bearing housing and a second upper bearing housing oppositely mounted in said transfer box housing, a first roller bearing mounted in said first upper bearing housing, a second roller bearing mounted in said second upper bearing housing, a first lower bearing housing and a second lower bearing housing oppositely mounted in said transfer box housing, a third roller bearing mounted in said first lower bearing housing, and a fourth roller bearing mounted in said second lower bearing housing, wherein said upper shaft is rotatably mounted concentrically within said first and second roller bearings, and wherein said lower shaft is rotatably mounted concentrically within said third and fourth roller bearings.

6. A trenching machine in accordance with claim 5, wherein in at least one of (a) said first and second upper bearing housings and (b) said first and second lower bearing housings, each of the bearing housings has an off center bore within which an associated one of said roller bearings is mounted, such that when the bearing housings having the off center bores are rotated, a distance between a center line of said upper shaft and a center line of said lower shaft changes.

7. A trenching machine in accordance with claim 1, wherein said transfer box assembly further comprises a first upper bearing housing and a second upper bearing housing oppositely mounted in said transfer box housing, a first roller bearing mounted in said first bearing housing, and a second roller bearing mounted in said second bearing housing; wherein said upper shaft is rotatably mounted concentrically within said first and second roller bearings, wherein each of said first and second upper bearing housings has an off center bore within which the associated one of the first and second roller bearings is mounted, such that when the first and second upper bearing housings are rotated, a center line of said upper shaft is moved upwardly or downwardly with respect to a center line of said lower shaft.

8. A trenching machine in accordance with claim 1, further comprising a first universal joint having an input end and an output end, and a second universal joint having an input end and an output end, wherein said input end of said first universal joint is coupled to said transmission output shaft, wherein said input end of said lower shaft is coupled to said output end of said first universal joint, wherein said input end of said second universal joint is coupled to said output end of said upper shaft, and wherein said output end of said second universal joint is coupled to said input shaft of said differential gearbox;

wherein said transfer box housing comprises a box body and a top lid, said top lid being removably attached to the top of said box body so as to allow access to components within said transfer box housing, wherein said transfer box housing is sealed so as to allow containment of lubricating oil for said transfer roller chain;

wherein said transfer box assembly further comprises a first upper bearing housing and a second upper bearing housing oppositely mounted in said transfer box housing, a first roller bearing mounted in said first upper bearing housing, a second roller bearing mounted in said second upper bearing housing, a first lower bearing housing and a second lower bearing housing oppositely mounted in said transfer box housing, a third roller bearing mounted in said first lower bearing housing, and a fourth roller bearing mounted in said second lower bearing housing, wherein said upper shaft is rotatably mounted concentrically within said first and second roller bearings, and wherein said lower shaft is rotatably mounted concentrically within said third and fourth roller bearings;

wherein in at least one of (a) said first and second upper bearing housings and (b) said first and second lower bearing housings, each of the bearing housings has an off center bore within which an associated one of said roller bearings is mounted, such that when the bearing housings having the off center bores are rotated, a distance between a center line of said upper shaft and a center line of said lower shaft changes.

* * * * *